US006176604B1

(12) United States Patent
Dubrovin et al.

(10) Patent No.: US 6,176,604 B1
(45) Date of Patent: Jan. 23, 2001

(54) MOTOR VEHICLE HEADLIGHT FITTED WITH A DISCHARGE LAMP AND IMPROVED ELECTROMAGNETIC SHIELDING MEANS

(75) Inventors: Alexis Dubrovin, Paris; Gérard Billot, Montfermeil, both of (FR)

(73) Assignee: Valeo Vision (FR)

( * ) Notice: Under 35 U.S.C. 154(b), the term of this patent shall be extended for 0 days.

(21) Appl. No.: 09/159,988

(22) Filed: Sep. 24, 1998

(30) Foreign Application Priority Data

Sep. 26, 1997 (FR) ..... 97 11995

(51) Int. Cl.[7] ..... F21W 101/10
(52) U.S. Cl. ..... 362/539; 362/538; 362/265
(58) Field of Search ..... 362/538, 539, 362/265, 519

(56) References Cited

U.S. PATENT DOCUMENTS 4,774,636 * 9/1988 Gaugel et al. ..... 362/519
4,893,218 * 1/1990 Dilk et al. ..... 362/519
4,920,459 * 4/1990 Rothwell, Jr. et al. ..... 362/265 X
4,926,301 * 5/1990 Liverance et al. ..... 362/519
5,132,881 * 7/1992 Wakimizu et al. ..... 362/539
5,584,559 * 12/1996 Toda ..... 362/539
5,607,228 3/1997 Ozaki et al. ..... 362/263
5,879,073 * 3/1999 Hori et al. ..... 362/538 X
5,895,113 * 4/1999 Ozaki et al. ..... 362/265 X

FOREIGN PATENT DOCUMENTS 197 03 233 7/1997 (DE) .

OTHER PUBLICATIONS

French Search Report dated Jun. 5, 1998.

* cited by examiner

*Primary Examiner*—Laura K. Tso
(74) *Attorney, Agent, or Firm*—Morgan & Finnegan, L.L.P.

(57) ABSTRACT

A motor vehicle headlight comprises a mirror having mounted therein a discharge lamp, a mask placed in front of the lamp, and a shielding plate of conductive material extending behind the mirror. The mask is made of conductive material and is connected to a fixed potential to capture the parasitic electromagnetic fields emitted forwards from the lamp. According to the invention, the shielding plate is constituted by a cover extending behind and along the mirror and connected to said fixed potential. The invention is applicable to ensuring electromagnetic compatibility for discharge lamp headlights.

23 Claims, 1 Drawing Sheet

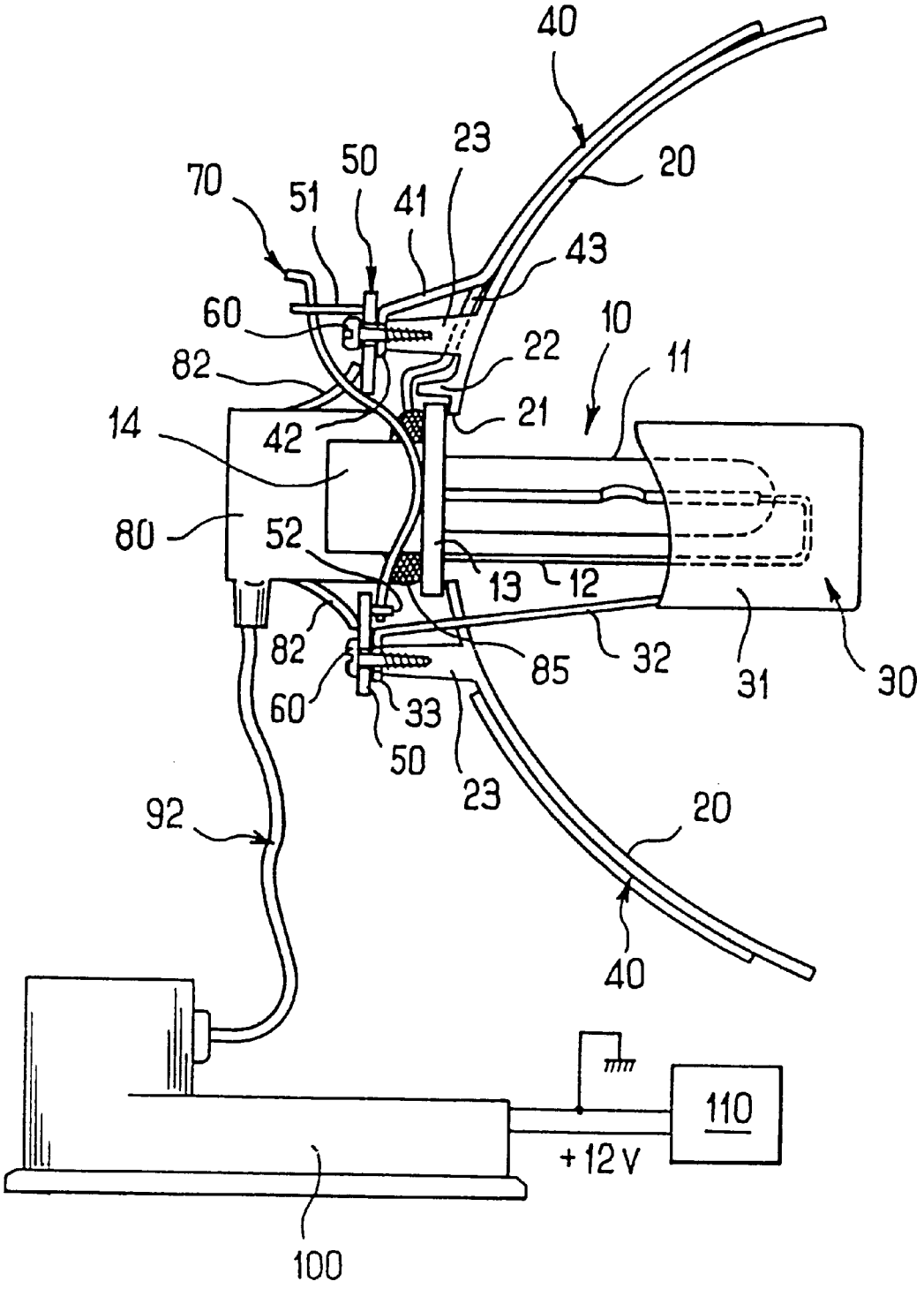
40
20
23
50
70
51
41
43
60
10
22
11
82
21
14
42
80
52
13
12
82
85
32
31
30
60
33
50
23
92
20
40
110
+12 V
100

MOTOR VEHICLE HEADLIGHT FITTED WITH A DISCHARGE LAMP AND IMPROVED ELECTROMAGNETIC SHIELDING MEANS

The present invention relates in general manner to motor vehicle headlights fitted with discharge lamps.

BACKGROUND OF THE INVENTION

Discharge lamps, in particular of the metal halide type (typically sodium iodide), are being used more and more frequently as light sources in such headlights.

They benefit from the considerable advantage of being capable, for comparable power consumption, of supplying light of an intensity that is considerably greater than that of conventional halogen filament lamps.

Nevertheless, a discharge lamp suffers from the drawback of generating, at the arc, electromagnetic fields which give rise to severe problems concerning electromagnetic compatibility requirements, both in transmission and in reception, as are generally laid down in specifications. In this respect, it may be observed that because of the increasing use of electronic circuits to perform various safety functions on board a vehicle, these requirements are nowadays becoming more and more severe.

Dispositions do indeed exist for providing a discharge lamp and its power supply circuits with as much shielding as possible, however such dispositions are generally incompatible with the environment specific to a motor vehicle headlight. Thus, for example, it is not possible to place the entire headlight in a Faraday cage that surrounds it completely since it is necessary to leave free the region where the light is delivered through the glass.

Document DE 197 03 233 A discloses a motor vehicle headlight which, to shield a discharge lamp, comprises in particular a shielding plate (14) mounted on the housing of the headlight behind the mirror which receives the discharge lamp so as to minimize disturbances in a backwards direction. That plate extends freely in the inside volume of the housing between the housing and the mirror.

That solution nevertheless presents certain drawbacks. Firstly, it makes the headlight more complicated to assemble since it is necessary to put the plate into place and to fix it to the housing before mounting the reflector. In addition, the simplified figures of that document (in particular FIGS. 3 and 4) do not show details such as the means for mounting the mirror in the housing, or the means for manually or automatically adjusting the orientation of the mirror to determine the position of the light beam, etc. FIG. 5, which does show that kind of detail, does not show the rear shielding plate. It will be understood that implementing said shielding plate simultaneously with the above-mentioned means is difficult and runs the risks of requiring the size of the headlight to be increased and/or of leaving places where there are gaps in the shielding plate, thereby degrading the quality of the shielding.

In addition, the plate described in that document must possess a relatively large central opening for access to the lamp, so the rear cap (7) of the headlight must be metallized to provide full shielding, which further increases cost price and can be difficult to do if the cap is a flexible cap made of elastomer or the like.

OBECTS AND SUMMARY OF THE INVENTION

The present invention seeks to provide a motor vehicle headlight fitted with a discharge lamp and with improved shielding means, particularly at the arc of the lamp, which means are simple in structure and in implementation, and which headlight does not have the above-mentioned drawbacks.

To this end, the invention provides a motor vehicle headlight comprising a mirror in which a discharge lamp is mounted, a mask placed in front of the lamp, and a shielding plate of conductive material extending behind the mirror, the mask being made of conductive material and being connected to a fixed potential to capture the parasitic electromagnetic fields emitted forwards from the lamp, wherein the shielding plate is constituted by a cover extending behind and along the mirror and connected to said fixed potential.

Preferred, but non-limiting features of the headlight of the invention are the following:

- the shielding cover is dimensioned so as to cover substantially all of the solid angle centered on the arc of the lamp that is not covered by the mask;
- said cover is constituted by a conducive metal sheet pressed against the back of the mirror;
- said cover is made by applying a coating to the rear face of the mirror;
- said cover is incorporated in the mirror, the mirror being made by being overmolded on the cover;
- the headlight includes an electrical link element fixed behind the mirror in the vicinity of the lamp, having said cover and said mask electrically connected thereto, and being itself electrically connected to vehicle ground;
- a lamp retaining means is mounted on said link element;
- the headlight further includes a high voltage connector for powering the lamp, and said connector includes at least one conductor element suitable for coming into contact with said link element when the connector is put into place;
- said link element is connected to vehicle ground via at least one conductive element and via shielding of a lamp power supply cable which is connected to the connector;
- the headlight further includes a generally annular conductive element situated in a gap between the connector and a collar of the lamp;
- said conductive element is flexible;
- said conductive element is connected to the cover by a tab integrally formed with said cover; and
- the mask is electrically connected to the cover via at least one conductive mounting tab of said mask.

BRIEF DESCRIPTION OF THE DRAWING

Other features, objects, and advantages of the present invention appear more clearly on reading the following detailed description of a preferred embodiment thereof, given by way of example and made with reference to the accompanying drawing, in which FIG. 1 is a diagrammatic fragmentary view in vertical axial section through a portion of a headlight of the invention.

MORE DETAILED DESCRIPTION

In conventional manner, a motor vehicle headlight comprises a housing that is closed in front by a glass and that defines an inside volume. These elements are omitted from the drawing in order to simplify it.

The inside volume of the housing receives a mirror 20 in which a discharge lamp 10 is mounted in conventional manner.

The lamp 10 has two electrodes received in a bulb 11, and also has an external current-return conductor 12. The lamp bears against the back of the mirror 20 via a radially-extending collar 13 and it is extended rearwards by a base 14 for connection to a power supply.

The mirror 20 has a lamp hole 21 surrounded by an axially-extending collar 22 for holding the lamp transversely relative to its axis.

On the rear face of the mirror there are provided, e.g. by being integrally molded therewith, a plurality of screw-receiving posts 23 extending parallel to the axis of the headlight.

In conventional manner, there is also provided a mask 30 serving both to mask direct light and to limit the field emitted by the arc of the lamp 10 so that it reaches only the working regions of the mirror 20.

The mask comprises a kind of bell 31 fixed in a manner described in detail below by means of at least one arm 32 passing through an orifice or a notch formed in the mirror in the vicinity of the lamp 10.

The mask and its support arm are made by folding sheet metal.

The means which shield the electromagnetic radiation emitted by the lamp 10, in particular by its arc, are described in detail below.

These means essentially comprise the above-described mask 30 which is made of a conductive material in combination with a cover 40 likewise made of a conductive material and extending behind and in the vicinity of the reflecting surface of the mirror 20.

The contours of the cover 40 are advantageously designed so that in combination with the contours of the mask 30, these two elements cover the entire solid angle of emission centered on the arc of the lamp 10.

In a first embodiment, the cover 40 is constituted by a thin sheet metal stamping which is applied during assembly substantially against the rear face of the mirror 20.

In a second embodiment, the cover 40 is incorporated in the mirror, the mirror being manufactured by overmolding a thermosetting material on the cover.

In a third embodiment, the cover can be a film of conductive material sprayed onto the rear face of the mirror by cathode sputtering or the like, or indeed it can be a conductive paint based on aluminum, on nickel-chrome, on copper, . . . , optionally coated in a protective varnish.

In all cases, the cover 40 is interrupted by a central opening to enable the lamp 10 to be inserted in the mirror 20.

Electrical connection between the various elements participating in the shielding is provided by means of a conductive plate 50 that is generally in the form of a ring fitted to the screw-receiving post 23 of the mirror. Thus, the cover 40 which is made in the present example out of stamped sheet metal, has a tab 41 whose free end 42 forms a terminal that is designed to be pressed against the plate 50 by the screw 60 received in one of the posts 23 of the mirror 20.

The plate 50 has a central opening to pass the base 14 of the lamp and the associated high voltage connector, as described below.

In a variant, a special conductive part can be provided for connecting the cover 40 to the plate 50, or indeed provision can be made for the cover and the plate to be formed as a single piece.

The high voltage connector 80 is of conventional type. It is fitted at its periphery with one or more flexible tabs 82 of conductive material that are designed to come into contact with the rear surface of the plate 50 when the connector is put into place.

It can also be seen that the support tab 32 for the mask 30 is folded at its free end at 33 to come into contact with the front face of the plate 50 on one of the posts 23, so that the screw 60 received in said post serves to hold said plate and said fold 33 in mutual contact.

Advantageously, means are also provided to provide shielding at the generally annular gap between the connector and the radial collar 13 of the lamp.

Specifically, this means is constituted by an annular bead of preferably flexible conductive material, e.g. a braid 85, of dimensions that are selected so that it substantially fills the above-mentioned gap.

The braid 85 is connected to ground, for example by means of a tab 43 integral with the shielding cover 40 and extending radially inwards from said cover so as to reach the braid.

Alternatively, any other type of connection can be provided between the annular conductive element 85 and one or other of the various parts that are grounded.

Thus, firstly the cover 40, secondly the mask 30, and thirdly the connector 80 are put into mutual electrical contact, thereby together defining an assembly for capturing the electromagnetic fields emitted by the lamp, which assembly is connected to vehicle ground in the present case by the shielding of the high voltage cable 92 connecting the connector 80 to the ballast circuit (housed in the shielded housing 100).

It may be observed at this point that the shielding of the high voltage power supply cable 92 is in contact, within the connector 80, with the, or each, conductor element 82 fitted to the connector. In a variant, provision can be made for the connector 80 to be covered by a lid of conductive material which is in contact both with the shielding of the cable 92 and with the plate 50, or directly with the cover 40.

The ring-shaped plate 50 also provides the mechanical function of fixing the lamp 10 in a manner analogous to that used for filament lamps.

The plate 50 thus comprises in conventional manner fittings 51 and 52 for hinged mounting and catching of a fixing spring clip 70 having a central portion which bears resiliently against the rear face of the collar 13 of the lamp 10.

Naturally, the fixing by means of screws 60 could be replaced by any other means for fixing the plate 50 to the back of the mirror 20, in particular assembly by crimping, by means of claws, by a bayonet mechanism, etc.

Finally, the ballast housing 100 to which the shielding of the high voltage conductor 92 is connected, or possibly a specific ground braid is connected to the ground of the on-board network 110 of the vehicle.

Naturally, the present invention is not limited in any way to the embodiments described and shown, and the person skilled in the art will know how to apply any variation or modification thereto within the spirit of the invention.

In particular, the invention is equally applicable both to parabolic type headlights, i.e. headlights in which the mirror itself generates the beam, possibly in co-operation with the glass, and to elliptical type headlights which include a lens for projecting a concentrated light spot formed at a second focus of the mirror.

What is claimed is:

1. A motor vehicle headlight comprising a mirror, a discharge lamp mounted in the mirror, a mask in front of the lamp, and a shielding plate of conductive material behind the mirror, the mask being made of conductive material and being connected to a fixed potential to capture the parasitic electromagnetic fields emitted forward from the lamp, wherein the shielding plate comprises a cover contacting at least a portion of a rear surface of the mirror, said cover being connected to said fixed potential.

2. A headlight according to claim 1, wherein the lamp emits electromagnetic fields over a first solid angle, the cover being dimensioned to cover substantially all of a second solid angle centered on an arc of the lamp that is not covered by the mask.

3. A headlight according to claim 1, wherein said cover comprises a conducive metal sheet pressed against the back of the mirror.

4. A headlight according to claim 1, wherein said cover is made by applying a coating to the rear face of the mirror.

5. A headlight according to claim 1, wherein said cover is incorporated in the mirror, the mirror being made by being overmolded on the cover.

6. A headlight according to claim 1, including an electrical link element fixed behind the mirror in the vicinity of the lamp, said cover and said mask being electrically connected to said link element, said link element being electrically connected to vehicle ground.

7. A headlight according to claim 6, further comprising a lamp retaining means mounted on said link element.

8. A headlight according to claim 6, further including a high voltage connector for powering the lamp, said connector including at least one conductor element for contacting said link element when the connector is put into place.

9. A headlight according to claim 8, wherein said link element is connected to vehicle ground via at least one conductive element and via shielding of a lamp power supply cable which is connected to the connector.

10. A headlight according to claim 8, further including a generally annular conductive element situated in a gap between the connector and a collar of the lamp.

11. A headlight according to claim 10, wherein said conductive element is flexible.

12. A headlight according to claim 10, wherein said conductive element is connected to the cover by a tab integrally formed with said cover.

13. A headlight according to claim 1, wherein the mask is electrically connected to the cover via at least one conductive mounting tab of said mask.

14. A motor vehicle headlight fitted with a discharge lamp comprising:

a mirror configured to receive a first end of a discharge lamp, the mirror provided with a shielding means contacting a rear surface of the mirror;

a mask of conductive material positioned in front of the second end of the discharge lamp; and a connector for connecting the mask and the shielding means to a fixed potential, wherein the shielding means and the mask are configured so that the shielding means and the mask together capture substantially all of a solid angle of parasitic electromagnetic fields emission centered on an arc of the lamp.

15. A headlight according to claim 14 wherein the shielding means comprises a thin sheet of conductive metal pressed against a rear face of the mirror.

16. A headlight according to claim 14 wherein the shielding means comprises a thin coating of conductive material applied to a rear face of the mirror.

17. A headlight according to claim 14 wherein the shielding means comprises a conductive core in the mirror, wherein the mirror is formed by molding over the conductive core and the conductive core has an attaching means for attaching to the fixed potential.

18. A headlight according to claim 14 wherein the mask is made of folded sheet metal.

19. A headlight according to claim 14 wherein the mask is electrically connected to the shielding means via at least one conductive mounting tab of the mask.

20. A headlight according to claim 14 wherein the fixed potential is vehicle ground.

21. A motor vehicle headlight fitted with a discharge lamp comprising:

a mirror configured to receive a first end of a discharge lamp;

a shield contacting a rear surface of the mirror;

a mask of conductive material positioned in front of the second end of the discharge lamp; and a connector for connecting the mask and the shield to a fixed potential.

22. A headlight according to claim 21, wherein the fixed potential is vehicle ground.

23. A motor vehicle headlight fitted with a discharge lamp comprising:

a mirror configured to receive a first end of a discharge lamp;

a coating of conductive material on at least a portion of a rear surface of the mirror; and a mask of conductive material positioned in front of the second end of the discharge lamp;

wherein the coating and the mask are connected.

* * * * *